US008823694B2

(12) United States Patent
Masazumi

(10) Patent No.: US 8,823,694 B2
(45) Date of Patent: Sep. 2, 2014

(54) DISPLAY APPARATUS

(75) Inventor: Naoki Masazumi, Kobe (JP)

(73) Assignee: Konica Minolta Holdings, Inc., Tokyo (JP)

( * ) Notice: Subject to any disclaimer, the term of this patent is extended or adjusted under 35 U.S.C. 154(b) by 279 days.

(21) Appl. No.: 13/123,999

(22) PCT Filed: Sep. 24, 2009

(86) PCT No.: PCT/JP2009/066500
§ 371 (c)(1),
(2), (4) Date: Apr. 13, 2011

(87) PCT Pub. No.: WO2010/047204
PCT Pub. Date: Apr. 29, 2010

(65) Prior Publication Data

US 2011/0199367 A1 Aug. 18, 2011

(30) Foreign Application Priority Data

Oct. 21, 2008 (JP) ..... 2008-270672

(51) Int. Cl.
*G09G 5/00* (2006.01)

(52) U.S. Cl.
USPC ..... 345/212; 345/214

(58) Field of Classification Search
USPC ..... 359/273
See application file for complete search history.

(56) References Cited

U.S. PATENT DOCUMENTS

| | | | | |
|---|---|---|---|---|
| 2006/0152438 | A1 | 7/2006 | Tanaka | 345/48 |
| 2007/0064303 | A1 * | 3/2007 | Schumacher et al. | 359/297 |
| 2008/0273005 | A1 * | 11/2008 | Chen et al. | 345/102 |
| 2009/0096738 | A1 * | 4/2009 | Chen et al. | 345/98 |

FOREIGN PATENT DOCUMENTS

| | | | |
|---|---|---|---|
| CN | 1714382 | A | 12/2005 |
| JP | 3428603 | B2 | 5/2003 |
| JP | 2003-241227 | A | 8/2003 |
| JP | 2004-170850 | A | 6/2004 |
| JP | 2005-257956 | A | 9/2005 |
| JP | 2006-330528 | A | 12/2006 |
| JP | 2007-072169 | A | 3/2007 |
| JP | 3985667 | B2 | 7/2007 |
| KR | 10-2005-0085084 | A | 8/2005 |
| TW | 200422995 | A | 11/2004 |
| TW | I248047 | B1 | 1/2006 |
| WO | WO 2004/049294 | A1 | 6/2004 |
| WO | WO 2009/096213 | A1 | 8/2009 |
| WO | WO 2010/047204 | A1 | 4/2010 |

* cited by examiner

*Primary Examiner* — William Boddie
*Assistant Examiner* — Sahlu Okebato
(74) *Attorney, Agent, or Firm* — Cozen O'Connor

(57) ABSTRACT

Provided is a display apparatus having: a voltage application control section to apply a voltage onto electrochemical display elements of an ED type for each frame period; a frame control section 84 to control the number of frequencies at which the period of the frame has elapsed after the start of the erasure or writing of an image by the voltage application unit with a frame number; an assigning section 82 to assign starting frame numbers at which the individual electrochemical display elements start the erasure or writing before the erasure or writing is performed; and a voltage application control unit 83 to control the voltage application unit so that the voltages may be applied to the individual electrochemical display elements on the basis of the stating frame numbers and the frame number.

8 Claims, 11 Drawing Sheets

FIG. 9a

| | 1 | 2 | 3 | 4 | 5 | | | | 1024 |
|---|---|---|---|---|---|---|---|---|---|
| 1 | 1 | 2 | 3 | 1 | 2 | . . . | 1 | 2 | 3 |
| 2 | 1 | 2 | 3 | 1 | 2 | . . . | 1 | 2 | 3 |
| 3 | 1 | 2 | 3 | 1 | 2 | . . . | 1 | 2 | 3 |
| ⋮ | | . . . | | | | | | | ⋮ |
| 768 | 1 | 2 | 3 | 1 | 2 | . . . | 1 | 2 | 3 |

FIG. 9b

| | 1 | 2 | 3 | 4 | 5 | | | | 1024 |
|---|---|---|---|---|---|---|---|---|---|
| 1 | 1 | 3 | 5 | 1 | 3 | . . . | 1 | 3 | 5 |
| 2 | 1 | 3 | 5 | 1 | 3 | . . . | 1 | 3 | 5 |
| 3 | 1 | 3 | 5 | 1 | 3 | . . . | 1 | 3 | 5 |
| ⋮ | | . . . | | | | | | | ⋮ |
| 768 | 1 | 3 | 5 | 1 | 3 | . . . | 1 | 3 | 5 |

| | | | | |
|---|---|---|---|---|
| 1 | 0 | 0 | 1 | 0 |
| 1 | 0 | 0 | 1 | 0 |
| 1 | 0 | 0 | 1 | 0 |

| | | | | |
|---|---|---|---|---|
| 2 | 1 | 0 | 2 | 1 |
| 2 | 1 | 0 | 2 | 1 |
| 2 | 1 | 0 | 2 | 1 |

| | | | | |
|---|---|---|---|---|
| 3 | 2 | 1 | 3 | 2 |
| 3 | 2 | 1 | 3 | 2 |
| 3 | 2 | 1 | 3 | 2 |

| | | | | |
|---|---|---|---|---|
| 7 | 6 | 5 | 7 | 6 |
| 7 | 6 | 5 | 7 | 6 |
| 7 | 6 | 5 | 7 | 6 |

| | | | | |
|---|---|---|---|---|
| 8 | 7 | 6 | 8 | 7 |
| 8 | 7 | 6 | 8 | 7 |
| 8 | 7 | 6 | 8 | 7 |

| | | | | |
|---|---|---|---|---|
| 8 | 8 | 7 | 8 | 8 |
| 8 | 8 | 7 | 8 | 8 |
| 8 | 8 | 7 | 8 | 8 |

| | | | | |
|---|---|---|---|---|
| 8 | 8 | 8 | 8 | 8 |
| 8 | 8 | 8 | 8 | 8 |
| 8 | 8 | 8 | 8 | 8 |

| | 1 | 2 | 3 | 4 | 5 | | 1024 | | |
|---|---|---|---|---|---|---|---|---|---|
| 1 | 2 | 3 | 1 | 2 | 3 | . . . | 2 | 3 | 1 |
| 2 | 2 | 1 | 3 | 2 | 1 | . . . | 2 | 1 | 3 |
| 3 | 1 | 2 | 3 | 1 | 2 | . . . | 1 | 2 | 3 |
| | | . . . | | | | | | | |
| 768 | 1 | 3 | 2 | 1 | 3 | . . . | 1 | 3 | 2 |

DISPLAY APPARATUS

RELATED APPLICATIONS

This is a U.S. National Stage under 35 U.S.C. §371 of International Application No. PCT/JP2009/066500, filed in the Japanese Patent Office on Sep. 24, 2009, and claims priority on Japanese Patent Application No. 2008-270672, filed on Oct. 21, 2008.

TECHNICAL FIELD

The present invention relates to a display apparatus, and in particular to a display apparatus having a plurality of electrochemical display elements arranged in a matrix state.

BACKGROUND

In recent years, owing to operation speed increase of personal computers, improvement of network infrastructure and increase of capacity as well as price reduction of data storage, there is expanding opportunities that information such as images and documents conventionally provided as printed matters printed on paper are obtained as more convenient electronic data and the electronic data is browsed.

To brows such electronic data, conventionally there have been mainly used liquid crystal displays, CRTs, and recently luminescent type display such as organic EL displays. However, in case the electronic data is document data in particular, the document data has to be gazed for relatively a long time. As shortcomings of the luminescent type display in general, there are known ocular fatigue due to flicker, inconvenience of portability, a restricted posture of reading and large consumption of electric power when reading long time.

As a display method to resolve the above shortcomings, an electrochemical display method is known. For example, an electro deposition method (hereinafter abbreviated to ED) using dissolution deposition of metal or metallic salt is known (for example, refer to Patent Documents 1 and 2).

The display element of the ED method can be driven by a low voltage of 3V or less which can be realized with a simple cell structure and it has a feature that the display quality is superior (paper-like bright white and tight black).

To drive the electrochemical display element of such as ED method a predetermined voltage exceeding a threshold value is applied at both ends of the electrochemical display element for a predetermined time. The display conditions can be controlled by the voltage and time.

However, in the display apparatus having the plurality of the electrochemical display elements arranged in the matrix state, a current to drive the display apparatus is large. In particular, in case of the ED method, since dissolution deposition of metal or metallic salt is utilized, a large current is drawn at an initial stage of applying the voltage and a peak voltage to drive the display apparatus becomes very large. To address the large current, a power source circuitry having large current capacity has to be prepared, which causes cost increase.

Also, since bus wiring common for the plurality of the electrochemical display elements and common electrodes such as transparent electrodes have resistance to some extent in general, the voltage decreases as the elements recede from the power applying source, thus there is a problem that unevenness of display occurs.

To solve the above problem, there is suggested a method to make erasing and writing of the image uniform across an entire screen by setting a magnitude and an application time of a selection voltage to be applied to the counter electrodes in accordance with the distances from the drive section of the transparent electrodes (refer to Patent Document 3).

PRIOR ART DOCUMENT

Patent Document

Patent Document 1: Japanese Patent No. 3428603
Patent Document 2: Unexamined Japanese Patent Application Publication No. 2003-241227
Patent Document 3: Unexamined Japanese Patent Application Publication No. 2005-257956

SUMMARY OF THE INVENTION

Problems to be Solved by the Invention

However, even in the method disclosed in the Patent document 3, the voltage is apply to each element at the same timing, and the peak current becomes very large, thus the problem that the power source circuitry having the large capacity of current is needed has not yet been solved.

The present invention has one aspect to solve the above problems and an object of the present invention is to provide a display apparatus, which can employ a power source circuitry having small capacity, capable of cost reduction.

Means to Solve the Problem

The present invention can be achieved by the following structures.

Structure 1. A display apparatus, provided with a plurality of electrochemical display elements arranged in a matrix state, to apply voltage with respect to each electrochemical display element in a period of frames of which number correspond a density of an image to be displayed, comprising:

an assigning section to assign at least two different starting frame numbers to each electrochemical display element;

a voltage application control section to start application of a voltage to the electrochemical display element to which the starting frame number is assigned, when the frame number having been assigned to each frame period and the starting frame number coincide; and a frame administration section to administrate a number of the frame periods which have been elapsed from a start of application of the voltage by the voltage application control section for each electrochemical display element, wherein the voltage application control section control to apply the voltage to each electrochemical display element in the period of desired number of times of the frame periods based on the administration of the frame administration section.

Structure 2. The display apparatus of structure 1, wherein the assigning section assigns the different starting frame number for each column of the plurality of the electrochemical display elements arranged in the matrix state.

Structure 3. The display apparatus of structure 1, wherein the assigning section assigns the different starting frame number for each column and each line of the plurality of the electrochemical display elements arranged in the matrix state.

Structure 4. The display apparatus of structure 1, further comprising:

an ON pixel calculation section to calculate a number of the pixels of the electrochemical display elements to which the voltage is to be applied based on image data of an image to be displayed and a dividing number determination section to determine a dividing number to divide the plurality of the electrochemical display elements in accordance with the number of the pixels calculated by the ON pixel calculation section, wherein the assigning section determines the starting frame number based on the dividing number.

Structure 5. The display apparatus of structure 1, wherein a maximum value of the starting frame number is smaller than a number of times of frame periods necessary for displaying a maximum density by each electrochemical display element.

Effect of the Invention

According to the present invention, by dispersing the timings to generate the current to drive the plurality of the electrochemical display elements, the power source circuitry having the small capacity can be employed thus cost reduction is possible.

BRIEF DESCRIPTION OF THE DRAWINGS

FIGS. 9*a* and 9*b* are explanatory diagrams to explain an example of a starting frame number $FS_{nm}$ assigned to each pixel.

EMBODIMENTS FOR ENFORCING THE INVENTION

The embodiment of the present invention will be described with reference to the drawings as follow.

Figure 1:
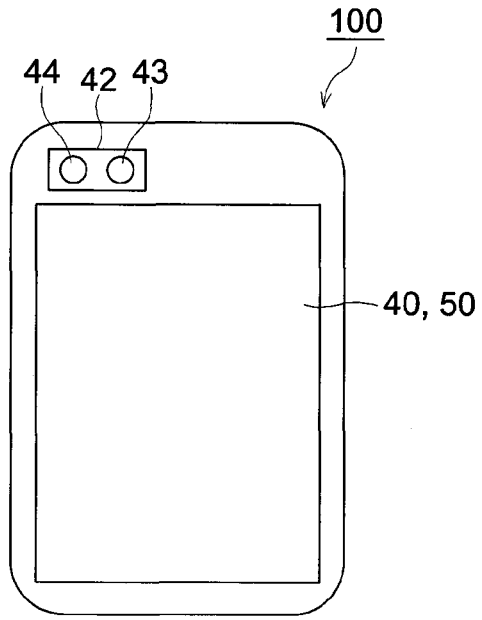
FIG. 1 is a schematic view of a display apparatus 100 related to an embodiment of the display apparatus of the present invention.

FIG. 1 is an external view showing an example of a display apparatus related to an embodiment of the present invention.

The display apparatus 100 is, for example, a tablet PC, an electronic book, or a PDA to display data such as images and characters stored in a memory 10 (refer to FIG. 5) on a display screen 50. As the display screen 50 electrochemical display elements 1 (refer to FIG. 2) representing display elements having a memory characteristic capable of gradation expression from white to black. On the operation section 42 a forward button 43 and a reverse button 44 configured with mechanical switches are disposed. For example, by a user to press the forward button 43, data of a subsequent page to data currently displayed on the display screen 50 is readout from the memory 10 and displayed. In the same manner, by the user to press the reverse button 44, data of previous page with respect to data currently displayed on the screen 50 is read out form the memory 10 and displayed.

Also, in FIG. 1, an upper part of the display screen 50 configures a touch panel 40. After changing to a handwriting mode via input operation on the touch panel 40, the user designates a position or an area on the screen and conducts handwriting input. The touch panel can be operated by a stylus pen or directly by a finger for input operation on the touch panel.

Figure 2A:
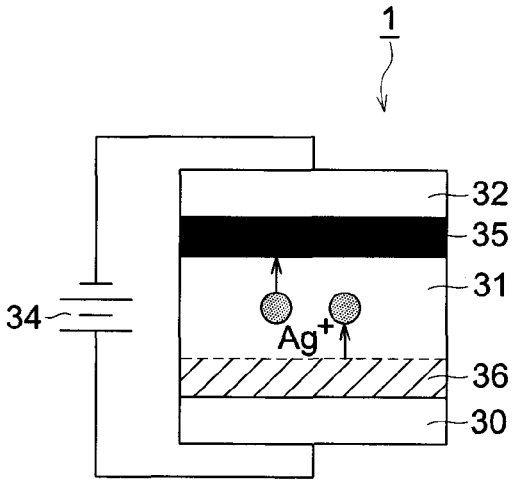
FIGS. 2*a* and 2*b* are schematic cross-sectional views showing a basic configuration of electrochemical display element 1 of the ED method used in an display apparatus 100 in the present embodiment.
Figure 2B:
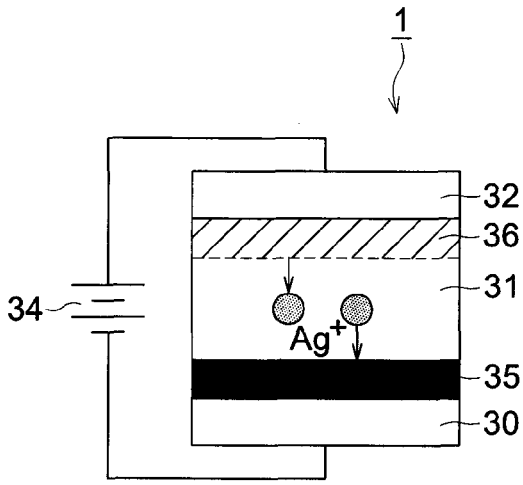

FIG. 2 is a schematic cross-sectional view showing a basic configuration of the electrochemical display element 1 of the ED method used in the display apparatus 100. FIG. 2 (*a*) shows a state where the electrochemical display element 1 is showing black and FIG. 2 (*b*) shows a state where the electrochemical display element 1 is showing white.

The electrochemical display element 1 of the ED method shown by FIG. 2 retains an electrolyte 31 between a transparent ITO (tin dope indium oxide) electrode 32 and a silver electrode 30. A power source 34 is connected with the TTO electrode 32 and the silver electrode 30. Incidentally the user observes the electrochemical display element 1 from the TTO electrode 32 side.

As FIG. 2 (*a*) shows, by applying a negative voltage onto the TTO electrode 32 from the power source 34 with respect to the silver electrode 30, an electric current flows in arrows direction in the figure and on the ITO electrode 32 side, there is occurred a disposing reaction of the silver included in the electrolyte 31. Hereinafter the negative voltage applied to the ITO electrode 32 is called a writing voltage.

Numeral 35 denotes the disposed silver and since the disposed silver absorbs light, the density of the electrochemical display element 1 observed from the ITO electrode 32 side becomes high. Numeral 36 schematically shows dissolved silver and a phenomenon that the disposed silver dissolved into the electrolyte 31 occurs at the silver electrode 30 side.

As FIG. 2 (*b*) shows, by applying a positive voltage onto the ITO electrode 32 from the power source 34 with respect to the silver electrode 30, an electric current flows in arrows direction in the figure, and on the ITO electrode 32 side, there is occurred a dissolution reaction of the silver. Hereinafter, the positive voltage applied to the ITO electrode 32 is called an erasing voltage. In a state of FIG. 2 (*a*), the disposed silver on the ITO electrode 32 side dissolves into the electrolyte 31, and by applying the erasing voltage for a predetermined time, then by an effect of a light dispersion material (for example, oxide titanium particle) mixed with the electrolyte 31, the electrochemical display element 1 observed from the ITO electrode side 32 becomes white which is an initial state.

The electrolyte 31 included in the electrochemical display element 1 can be, for example, prepared by phase inversion of the silver from an aqueous silver salt solution to a non-aqueous silver salt solution. Such aqueous silver salt solution can be prepared by dissolving a publicly known silver salt into water.

Figure 3:
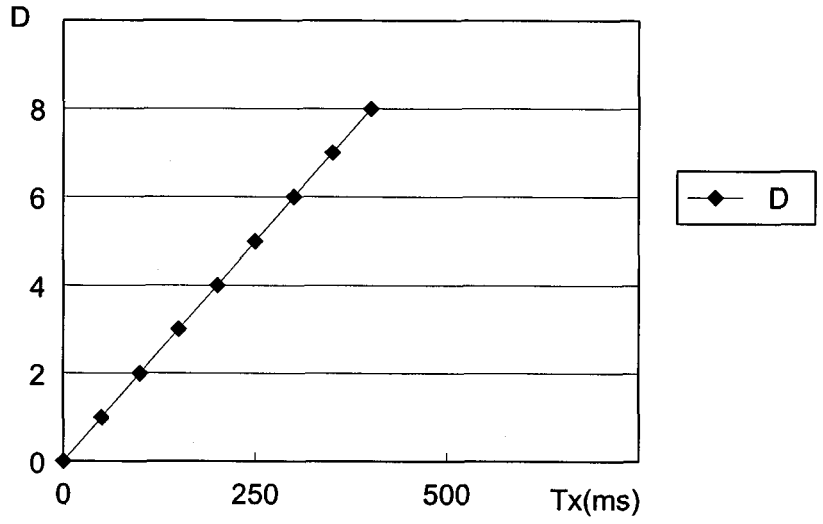
FIG. 3 is a diagram describing a relation between a time of applying a writing voltage to the electrochemical display element 1 and display density D.

FIG. 3 is a diagram explaining a relation between an application time of the writing voltage onto the electrochemical display element 1 and display density D.

In FIG. 3, a horizontal axis Tx denotes the application time of the writing voltage, and numerals 0 to 8 in the vertical axis denotes a value of the display density D. The numeral 0 means a minimum display density (white) of the electrochemical display element 1 and the numeral 8 means a maximum display density (black) of the electrochemical display element 1, thus nine steps of graduation 0 to 8 are indicated. As FIG. 3 shows, in the electrochemical display element 1 of the present invention, when a predetermined writing voltage is applied, the displayed density D increases in accordance with the writing time Tx.

Figure 4:
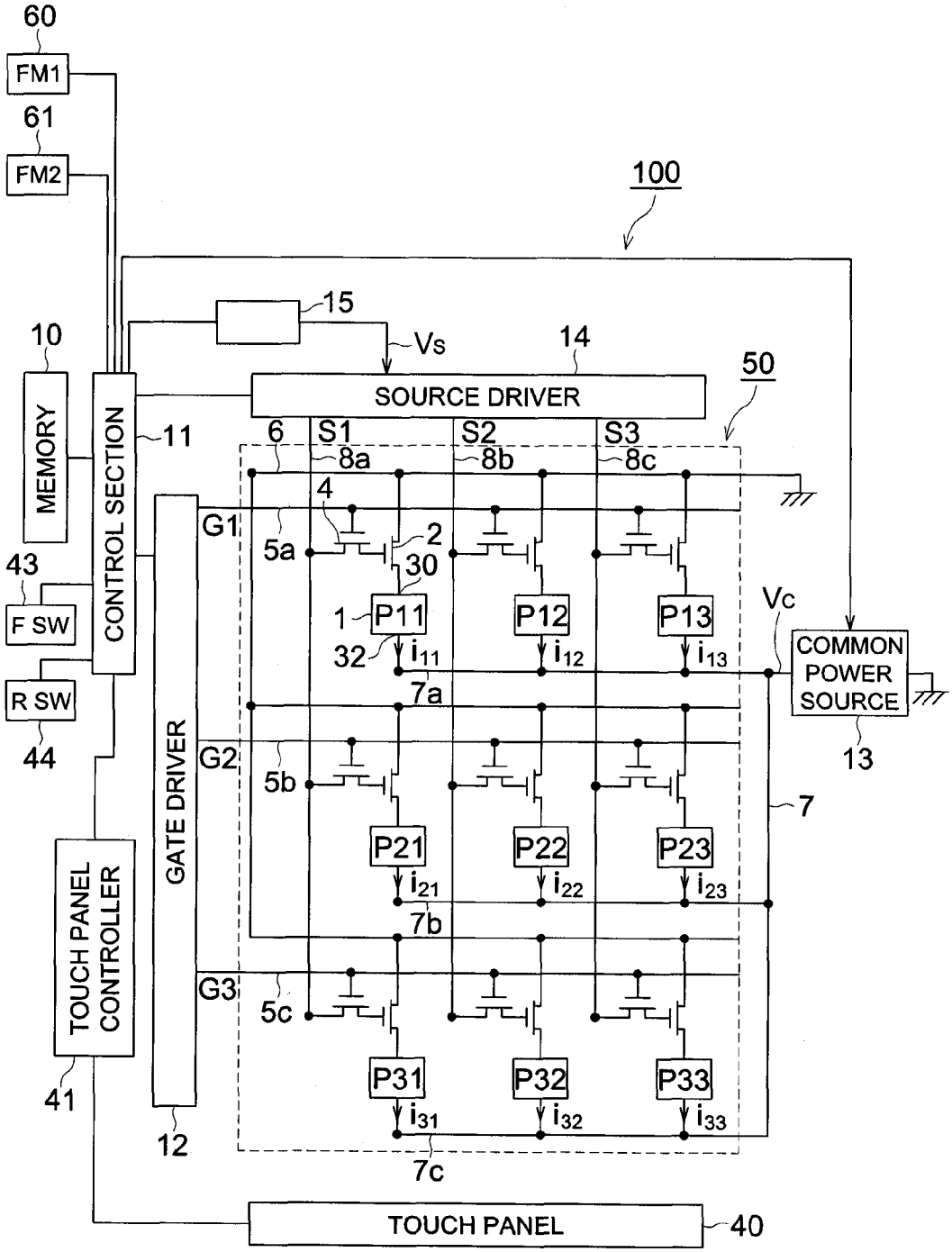
FIG. 4 is a diagram showing an electrical configuration of the display apparatus 100 in the present invention.
Figure 5:
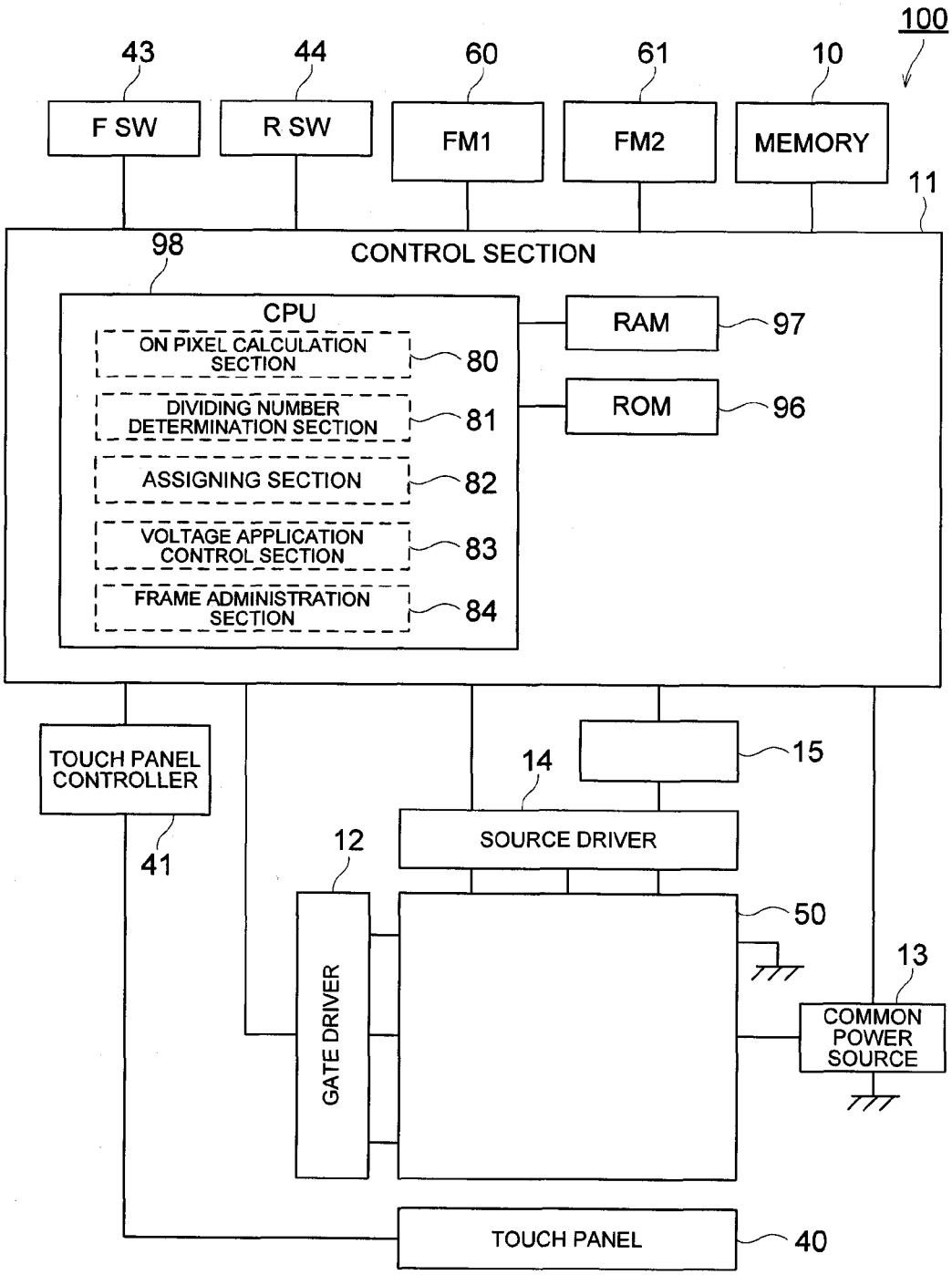
FIG. 5 is a block diagram showing an internal configuration of a control section 11 of the display apparatus 100 in the present invention.

FIGS. 4 and 5 show a configuration of the display apparatus of the present embodiment. FIG. 4 shows a configuration having three lines×three columns only to simplify description. However to display an image on the display screen 50 more pixels in n lines×m columns are used. For example, in case the display screen 50 of XGA is configured, the number of the pixels will be 1024×768. FIG. 5 is a block diagram to describe an internal configuration of a control section 11.

In FIG. 4, each pixel is provided with the electrochemical display element 1, a driving transistor 2 and a switching transistor 4. In FIG. 4, each electrochemical display element 1 of pixel in n lines×m columns is denoted by P nm. For example, the electrochemical display element 1 of a pixel in the fust line and a fust column is denoted as P11, and the electrochemical display element 1 of a pixel in the fust line and a second column is denoted by P12, The symbols 5*a*, 5*b* and 5*c* are scanning lines which connects gates of the switching transistors 4 arrayed in a line direction and the gate drivers 12 each other. The symbols 8*a*, 8*b* and 8*c* denote signal lines to connect sources of the switching transistors for each pixel arrayed in the line direction and the source drivers 14 each other. The gate driver 12 selectively outputs output voltages G1, G2 and G3 on the scanning lines 5*a*, 5*b* and 5*c* based on control of the control section 11 so as to conduct on/off control of the switching transistors 4 and to select a line which applies a control voltage onto the drive transistor 2. A drain of the drive transistor 2 is connected to the silver electrode 30 of the electrochemical display element 1 of each pixel and the source is connected to the ground via GND bus line 6.

The source driver 14 having driver circuits for each of signal lines 8*a*, 8*b* and 8*c* outputs output voltages S1, S2 and S3 on the signal lines 8*a*, 8*b* and 8*c* based on control of the control section 11. Driver circuits of the source driver 14 are binary drivers for on/off and outputs a control voltage Vs inputted to the source driver 14 based on control of the control section 11 or 0V representing an off voltage.

The control voltage source 15 outputs the control voltage Vs based on control of the control section 11 and supplies to the source driver 14.

The bus lines 7*a*, 7*b* and 7*c* are connected with ITO electrodes 32 of the electrochemical display elements 1 of respective pixels for respective lines and an end of each bus line is connected with a common power source 13. The common power source 13 outputs a common voltage Vc representing a negative voltage or positive voltage with a command of the control section 11.

When the output voltages S1, S2 and S3 of the source driver 14 are Vs which represent an On voltage, if the switching transistors 4 are turned on, Vs is applied onto the gates of the transistors 2, the driving transistors 2 are turned on and the common voltage Vc is applied onto the electrochemical display elements 1. After that, the driving transistors 2 stay on via a storage capacity, even the switching transistors 4 are turned off.

When the output voltages S1, S2 and S3 of the source driver 14 are 0V representing the off voltage, if the switching transistors 4 are turned on, 0V is applied onto the gates of the driving transistors 2, then the driving transistors are tuned off The memory 10 is configured with recording media such as a ROM (Read Only Memory) and a flash memory.

A fust frame memory 60 and a second frame memory 61 are frame memories for one screen respectively having a memory area corresponding to the number of the pixels of the display screen 50. The first frame memory 60 stores a value X of the display density as fust image data to be subsequently displayed on the display screen 50 by the electrochemical display elements 1. The second frame memory 61 stores a value Y of the display density as second image data currently being displayed on the display screen 50 by the electrochemical display elements 1. In the figures, the fust frame memory 60 and the second frame memory 61 are respectively denoted by FM1 and FM2.

A touch panel controller 41 drives the touch panel 40 with a command of the control section 11 and transmits input position information readout from the touch panel 40 to the control section 11.

The control section 11 is configured with a CPU and so forth to control the entire display apparatus 100 based on a program.

An internal configuration of the control section 11 will be described with reference to FIG. 5.

The control section 11 is configured with a CPU 98 (Central Processing Unit), a RAM 97 (Random Access Memory), a ROM 98 (Read Only Memory) and so forth. The control section 11 reads out a program stored in the ROM 96 representing a non-volatile memory section and upload onto the RAM 97, then controls each section of the display apparatus 100 in accordance with the program.

In FIG. 5, a ON pixel calculation section 80, a dividing number determination section 81, an assigning section 82, a voltage application control section 83 and a frame administration section 84 described in the CPU 98 indicate functions to be performed by executing the program by the CPU 98 as function blocks. Incidentally, while the above function blocks are realized by the software in the present invention, it can be realized by hardware.

The ON pixel calculation section 80 calculates number of the pixels of the electrochemical display elements 1 to which the erasing or writing voltage is applied in subsequent image displaying based on the fust image data stored in the first frame memory 60.

The dividing number determination section 81 judges that into how many groups the plurality of the electrochemical display elements 1 are divided in accordance with the number of the pixels calculated by the ON pixel calculation section 80 and determines the dividing number.

The assigning section 82 determines a starting frame number at which application of the erasing voltage or the writing voltage onto each electrochemical display element 1 starts, before erasing or writing. The assigning section 82 assigns at least two different starting frame numbers to each electrochemical display element 1. Whereby, as described later, timings to start applying the erasing or writing voltage can be delayed.

The voltage application control section 83 controls the driving transistors 2 via the gate driver 12 and the source driver 14 so that the erasing voltage or the writing voltage is applied onto each electrochemical display element 1 based on the starting frame number and the frame number to be described. The voltage application control section 83 starts application of the voltage onto the electrochemical display element 1 to which the starting frame number is assigned when the frame number assigned to each frame period and the starting frame number coincide, and controls application of the voltage so that the voltage is applied onto each electrochemical display element 1 during a desired number of times of frame periods.

The frame administration section 84 administrates an elapsed time from starting application of the erasing or the writing voltage via the driving transistors 2 based on control of the voltage application control section 83 by adding the frame numbers every time the frame period elapses. As described later, the administration by the frame administration section 84 is executed by renewing the display density Y of the second frame memory 61 every time the frame period elapses. The electrochemical display elements 1 are administrated respectively.

Next, control when an image is displayed on the display apparatus 100 of the present embodiment will be described with reference to FIG. 6 and FIG. 7.

Figure 6:
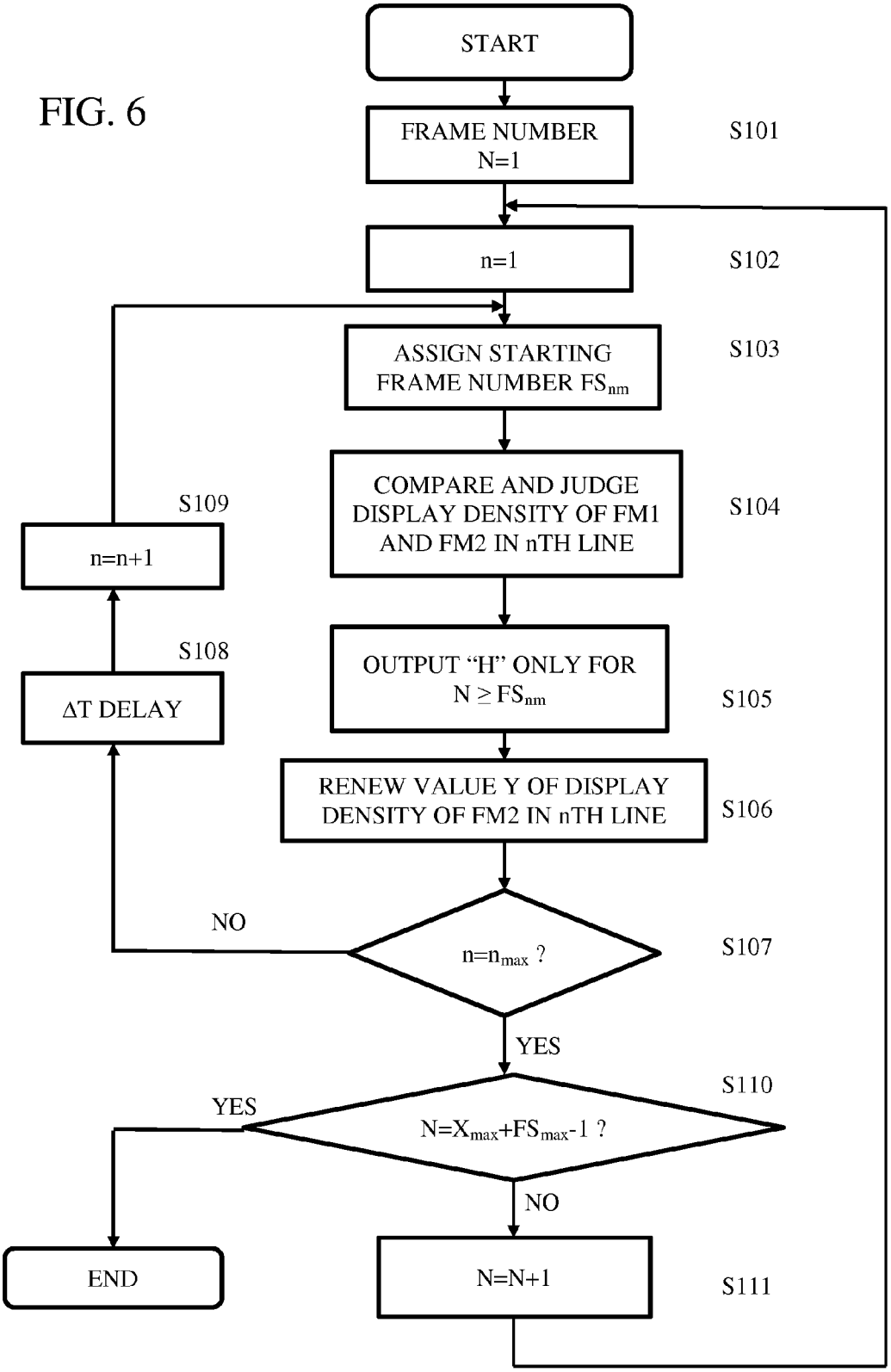
FIG. 6 is a flow chart to describe a procedure of control of the control section 11 in the present embodiment.
Figure 7:
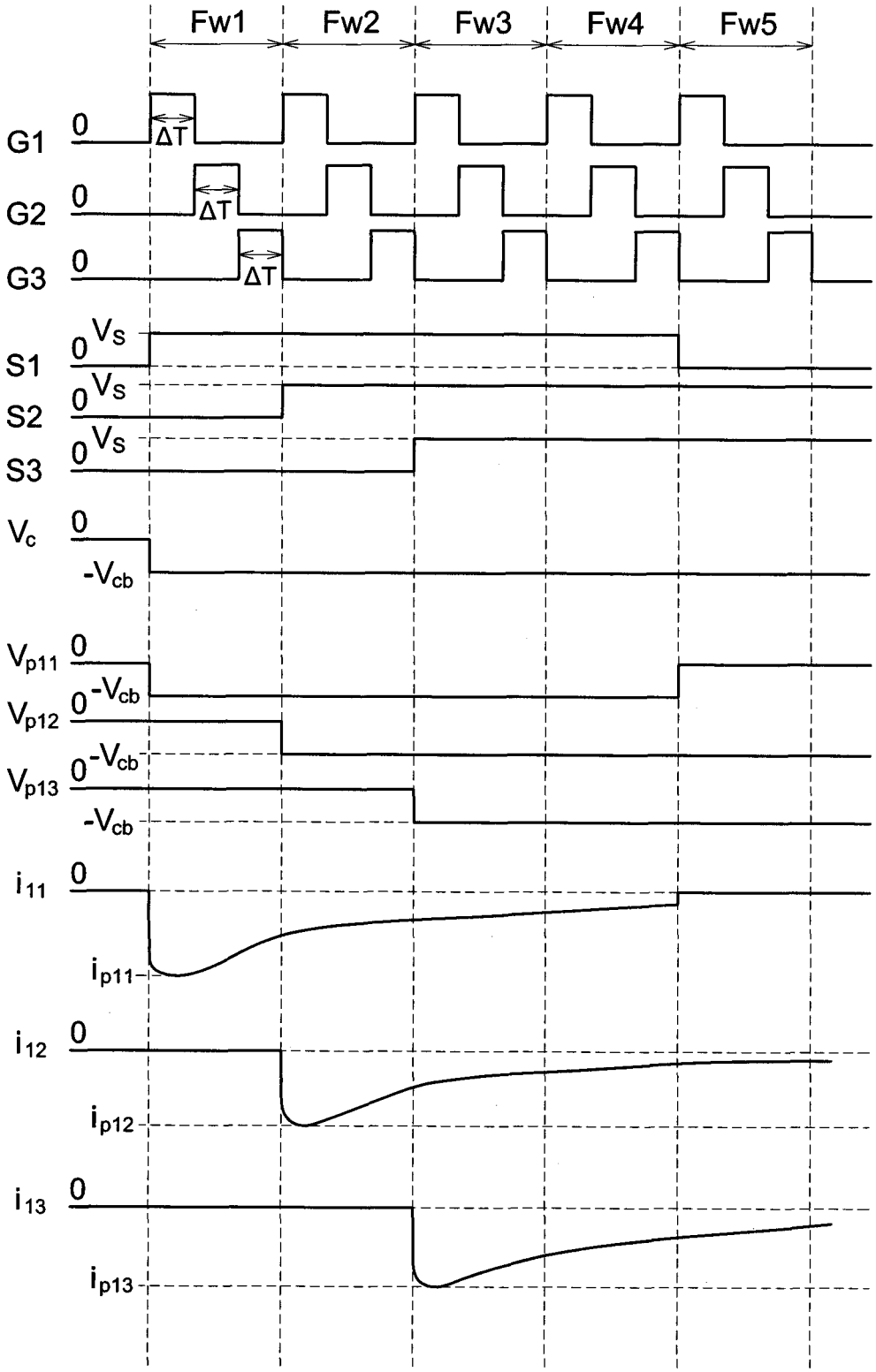
FIG. 7 is a flow chart showing changes of voltages of each section when an image is displayed by the electrochemical display element 1.

FIG. 6 is a flow chart to describe a procedure of the control of the control section 11 in the present embodiment, and FIG. 7 is a time chart to indicate changes of voltages of each section when the image is displayed by the electrochemical display elements 1.

In the following description, there is described an example to write an image by changing the display density of the electrochemical display elements 1 from a state where the display density of the electrochemical display elements 1 is 0 (white) by erasing an image in advance. In the above case, when starting writing, the writing voltage has to be applied into the most of the electrochemical display elements 1, however in the present embodiment by dispersing the timings of applying the writing voltage, an excessive peak current is inhibited to flow.

The flow chart in FIG. 6 will be described with reference to the time chart in FIG. 7 as follow.

Incidentally, writing of the image is carried out in each frame period basis. The frame period is denoted by FwN (N denotes the frame number).

At the beginning of writing, the CPU 98 instructs the common power source 13 to make the common voltage Vc to be a negative voltage of $-V_{cb}$.

S101 is a step of frame number N=1.

The frame administration section 84 initializes N to be N=1.

S102 is step of n=1.

The CPU 98 initializes n as a line number n=1, and makes G1 to be "H" via the gate driver 12.

S103 is a step where the starting frame number FS is assigned to each column of the pixels.

The assigning section 82 calls a FS assigning routine (refer to FIG. 8) to assign the starting frame number $FS_{nm}$ to each pixel in n th line and in m th column In the present example, 1 is assigned to the starting frame number $FS_{n1}$ of the pixel in the fust column, 2 is assigned to the starting frame number $FS_{n2}$ of the pixel in the second column, and 3 is assigned to the starting frame number $FS_{n3}$ of the pixel in the third column by the FS assigning routine. The procedure to assign the starting frame numbers by the FS assigning routine and other examples will be described specifically afterward.

S104 is a step to compare the values of display density in the first frame memory 60 and the second frame memory 61.

The voltage application control section 83 respectively reads out and compares the value $X_{nm}$ of display density stored in the fust frame memory 60 and the value $Y_{nm}$ of display density stored in the second frame memory 61, subsequently in a line direction of n th line, and when $X_{nm}>Y_{nm}$, the result of judgment is "H" and when $X_{nm}\leq Y_{nm}$ the result of judgment is L". The CPU 98 temporally stores the judgment results in the RAM 97.

For example, as for the pixel in the fust line and the first column, if X11 were 8 and Y11 were 0, the judgment result is "H".

S105 is a step to output "H" only for the columns of $N\geq FS_{nm}$.

The voltage application control section 83 judges only the columns of $N\geq FS_{nm}$ among the columns whose results of comparison in the step S104 temporally stored in the RAM 97 was "H", as "H", and others as "L". Then the voltage application control section 83 turns on the drivers circuits of the source driver 14 which have been judged as "H" and turns off the driver circuits of the source driver 14 which have been judged as "L".

In the present embodiment, since the starting frame number N11 of the first line and first column is 1, as FIG. 7 shows, the output S1 of the source driver 14 in the frame $F_w$1 is Vs and outputs S2 and S3 are 0. In the same manner, the starting frame number N12 of the fust line and the second column is 2, thus outputs S1 and S2 in frame $F_w$2 are Vs and the output S3 is 0. The starting frame number N13 of the fust line and the third column is 3, thus in the frame Fb3, the output S1, S2 and S3 becomes Vs.

S106 is a step to renew the value Y of the display density inn th line in the second frame memory 61.

The CPU 98 rewrites the value Y of the display density corresponding to the pixel inn th line in the second frame memory 61. Namely, the value Y of the display density for the pixel to which the writing voltage is applied in a period of one frame period is incremented by one. For example, assuming that the value Y11 of the display density in the fust line and the first column was 0, the value Y11 is rewritten to be 1.

S107 is a step to compare n and $n_{max}$.

The CPU 98 compares n with maximum line $n_{max}$ of the display apparatus. In the example in FIG. 4, $N_{max}$ is 3.

In case of $n\neq n_{max}$, (step S107; No) step S108 is executed.

S108 is a step to delay by ΔT.

The CPU 98 creates a delay of ΔT by an internal timer. During the period of the delay, the output Gn of the gate driver 12 is maintained.

S109 is a step of n=n+1.

The CPU 98 makes Gn to be "L" since comparison operation is not completed up to the maximum line $n_{max}$, and makes Gn+1 to be "H", after that n is incremented by 1(n=n+1) and process returns to step S103.

In case of $n=n_{max}$, (step S107; Yes), step S110 is executed.

S110 is a step to compare N with $X_{max}+FS_{max}-1$.

The CPU 98 compares the frame number N with the maximum value $X_{max}$ of the value X of the display density+maximum value $FS_{max}$ of the maximum $FS_{max}$ of the starting frame number −1. In the present example, the maximum value $X_{max}$ of the value X of the display density is 8, and the maximum value FS max of the starting frame number is 3. Therefore, in the present example, whether or not the frame number N is 10 is judged in the present step. Namely, in the present step whether or not a control of number of times of frame periods necessary to display the image of the one screen is executed is judged in the present embodiment In case of $N\neq X_{max}+FS_{max}-1$(step S110; No.), step S111 is executed.

S111 is a step of N=N+1.

The CPU 98 conducts N=N+1 since the maximum frame N max is not achieved and returns to step S102.

In case of $N=X_{max}+FS_{max}-1$(step S110; Yes), the process is terminated since the maximum frame N max is achieved.

The description of the flow chart is completed.

Next, the voltages $V_{p11}$, $V_{p12}$, $V_{p13}$ to be applied to the electrochemical display elements P11, P12, and P13 as well as the currents $i_{11}$, $i_{12}$ and $i_{13}$ flowing into the electrochemical display elements P11, P12, and P13 will be described with reference to the time chart in FIG. 7, Incidentally, to simplify the drawings, the time chart in FIG. 7 shows only up to the frame $F_w$5.

As described in the flow chart in FIG. 6, in the present example, the starting frame number FS 11 of P11 is 1, the starting frame number FS 12 of P12 is 2, and the starting frame number FS 13 of P13 is 3. Thus the output S1 of the source driver 14 in frame $F_w$1 is Vs and the S2 and S3 are 0.

In frame Fw1, $-V_{cb}$ is applied to P11 and the current $i_{11}$ flows. In the example in FIG. 7, the value X of the display density of P1 is 4, and $-V_{cb}$ is applied to P11 up to the frame $F_w$4. As FIG. 7 shows, the current $i_{11}$ flows as a peak current $i_{p1}$ at initial stage of application of the voltage and reduces gradually.

Also, while being not illustrated, at a timing where G2 becomes "H" the current $i_{21}$ flows in P21 and a timing where G3 becomes "H" the current $i_{31}$ flows in P31.

In the frame Fw2, $-V_{cb}$ is applied to P12 and the current $i_{12}$ flows. For example, the value X of the display density of P12 is 8, and $-V_{ca}$ is applied to P12 up to the frame $F_w$9 equivalent to a period of eight frames As FIG. 7 shows, the current $i_{12}$ flows as a peak current $i_{p22}$ at initial stage of application of the voltage and after that reduces gradually.

Also, while being not illustrated in FIG. 7, at a timing where G2 becomes "H" the current $i_{22}$ flows in P22 and at a timing where G3 becomes "H" the current $i_{32}$ flows in P32.

In the frame $F_w$3, $-V_{cb}$ is applied to P13 and the current $i_{13}$ flows in the same manner.

In the example in FIG. 7, $-V_{cb}$ is applied to all electrochemical display elements 1 in the frame $F_w$4, and the current flows in electrochemical display elements 1 except P11, P21 and P31 in frame $F_w$5.

As above, in the present embodiment when writing is started, since the start timing of the peak current to flow in each electrochemical display element 1 is dispersed, the peak value of the current supplied form the power source can be suppressed. Also, an effect to display due to voltage depression in the buss lines 7*a*, 7*b* and 7*c* to which the electrochemical display element 1 is connected can be suppressed.

Therefore, an image having less unevenness can be displayed using a power source of a simple configuration having a small capacity.

Next, the FS assigning routine will be described.

Figure 8:
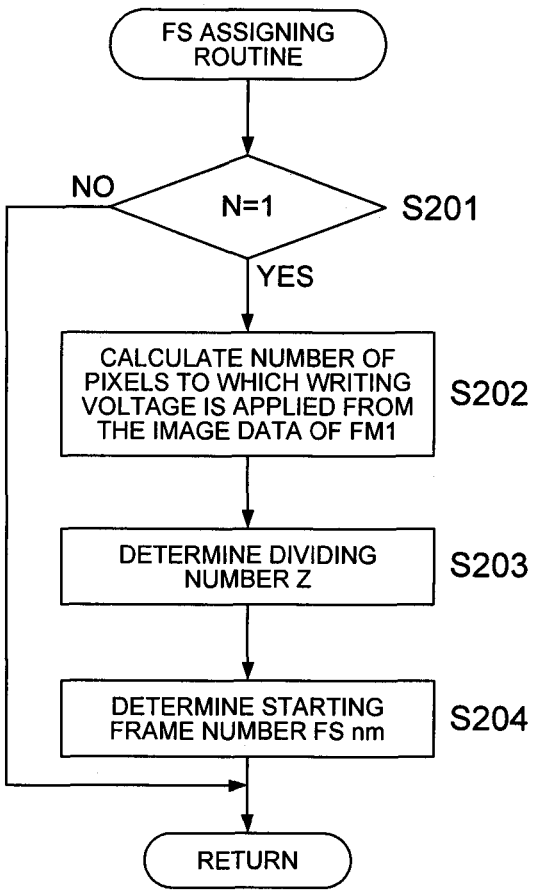
FIG. 8 is a flow chart to describe a procedure of a FS assigning routine in the present embodiment.

FIG. 8 is a flow chart to explain a procedure of the FS assigning routine in the present embodiment. A procedure from calling the FS assigning routine from a main routine will be described.

S201 is a step to judge whether or not the frame number N is 1.

In case of N≠1, (step S110; No), the process returns to the original routine.

In case N=1, (step S110; Yes), the process proceeds to step S202.

S202 is a step to calculate the number of the pixels to which the writing voltage is applied from the value X of the display density.

The ON pixel calculation section 80 calculates the number of the pixels $G_{ON}$ to be written from the value X of the display density stored in the fust frame memory 60. Specifically, the number of the pixels $G_{ON}$ having the display density value X≠0.

S203 is a step to determined a dividing number Z.

The dividing number determination section 81 determines the dividing number Z from the pixel number $G_{ON}$ calculated in step S202 in accordance with a table stored in the ROM 96 in advance.

Next, a specific example that the dividing number determination section 81 determines the dividing number Z using a table 1 shown below will be explained.

TABLE 1

| Number of Pixel $G_{ON}$ | Dividing number Z |
|---|---|
| $629146 < G_{ON} \leq 786432$ | 3 |
| $393216 < G_{ON} \leq 629146$ | 2 |
| $0 < G_{ON} \leq 393216$ | 1 |

Table 1 is an example of the display apparatus 100 having display screen 50 with the number of the pixels (1024×768) of XGA and the total number of the pixels is 786432. The left column in Table 1 shows the range of $G_{ON}$ and the right column shows the dividing number Z corresponding to the range thereof As Table 1 shows, when $629146<G_{ON}\leq 786432$. the dividing number Z is 3, when $393216<G_{ON}\leq 629146$ the dividing number Z is 2 and when $0<G_{ON}\leq 393216$, the dividing number is 1.

As above, when the number of the pixels $G_{ON}$ to be written is large, the dividing number Z is increased to disperse the timing to start writing so as to reduce the peak current to flow at starting. On the other hand, when the number of the pixels $G_{ON}$ to be written is small, the dividing number Z is decreased since the current to flow at starting is small so as to make a total writing time short.

S204 is a step to determine the starting frame number $FS_{nm}$.

The assigning section 82 determines the starting frame number $FS_{nm}$ of each pixel based on the dividing number Z and column number m The assigning section 82 determines the starting frame number $FS_{nm}$ by, for example, the formula (1) below.

$$FS_{nm}=\mathrm{mod}((m+2)/Z)+1 \quad (1)$$

Z denotes the dividing number, n denotes the line number, m denotes the column number and mod (A/B) is a function to obtain remainder of A/B.

As above, the process of the FS assigning routine is completed and the process returns to the original routine.

In the present embodiment, as FIG. 4 shows, since the electrochemical display elements 1 are connected with each of bus lines 7*a*, 7*b* and 7*c* disposed for each line, by differentiating the starting frame numbers $FS_{nm}$ for each column, the application timings of the voltages onto the electrochemical display elements 1 in each line are dispersed.

Not only for the present embodiment, it is preferable that the application timing of the voltage applied onto the electrochemical display elements 1 is dispersed by determining the starting frame numbers $FS_{nm}$ in accordance with wiring of the power source (common power source 13) of the electrochemical display elements 1. For example, in case the bus line 7 is disposed for each column, by setting the different starting frame number$_{nm}$ for each column, the application timings of the voltages applied onto the electrochemical display elements 1 are dispersed. Also, for example, in case the bus line 7 is disposed for each predetermined area, by setting the starting frame numbers $FS_{nm}$ so that the starting frame numbers FS disperse for each predetermined area in the area, and the application timings of the voltages applied onto electrochemical display elements 1 are dispersed.

Figure 10A:
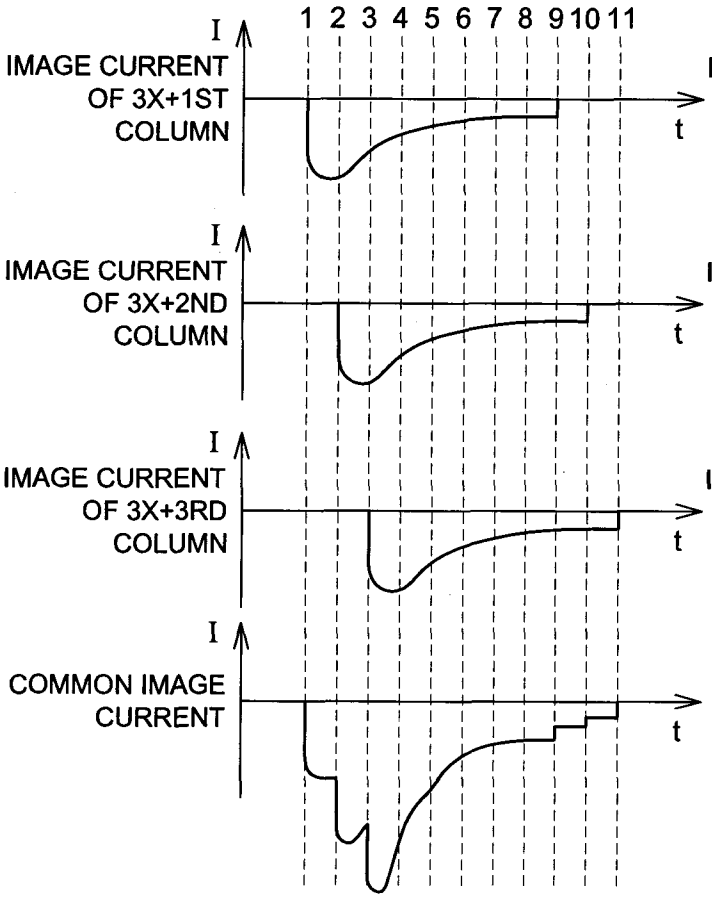
FIGS. 10*a* and 10*b* are explanatory diagrams to explain an example of changes of currents drawn by each pixel and a power source current through time.
Figure 10B:
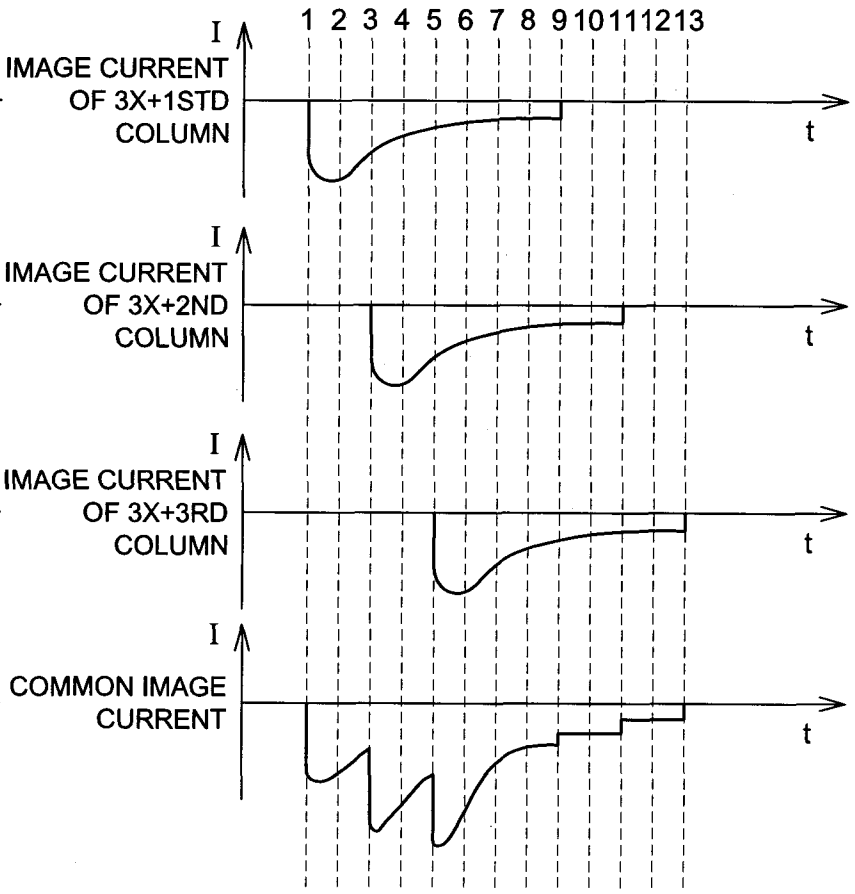

Next, a specific example of the starting frame number $FS_{nm}$ assigned to each pixel in the FS assigning routine and examples of a peak currents with reference to FIG. 9 and FIG. 10. FIG. 9 is an explanatory diagram to explain the example of the starting frame number $FS_{nm}$ assigned to each pixel, and FIG. 10 is an explanatory diagram to explain an example of changes of a current flowing each pixel and a current of the power source as the time elapses.

FIG. 9 (*a*) shows an example of the display apparatus 100 having a display screen 50 with pixel number (1024×768) of XGA in case of the dividing number Z=3. When the assigning section 82 determines via the formula (1), as FIG. 9 (*a*) shows the starting frame number FS nm is assigned for each column as 1, 2, 3, 1, 2, 3 . . . .

FIG. 10 (*a*) shows current waves of respective sections when the starting frame number$_{nm}$ is assigned as in FIG. 9 (*a*). The horizontal axis is a time axis and the numerals on the horizontal axis the frame numbers. As FIG. 10 (*a*) shows, the current flowing in each pixel becomes a maximum at start of flowing and gradually decreases. Assuming that X denotes integers including 0, in the above example, the start timings to flow a pixel current at 1+3 X th column, a pixel current at 2+3 X th column, and a pixel current at 3+3 X th column, are dispersed to the fust frame, the second frame and the third frame respectively. Whereby, as FIG. 10 (*a*) shows, the peak value of the power source current of the common power source 13 can be suppressed. Incidentally, in FIG. 10 the power source current of the common power source 13 is abbreviated as a common power source current.

As the difference of the starting frame number $FS_{nm}$ of each column is increased, an effect to disperse the timings at which the peak currents flow is enhanced thus the peak value of the power source current of the common power source can be suppressed.

FIG. 9 (*b*) is an example where the starting frame numbers $FS_{nm}$ largely differ. The starting frame numbers are assigned as 1, 3, 5. 1, 3, 5 . . . . Incidentally, FIG. 9 (*b*) also shows an example of the display apparatus 100 having a display screen 50 with the pixel number (1024×768) of XGA in case of the dividing number Z=3.

In the example of FIG. 9 (*b*), the assigning section 82, determines the starting frame numbers $FS_{nm}$, for example, by the formula (2) below.

$$FS\,nm = \mathrm{mod}((m+2)/Z)+2 \quad (2)$$

FIG. 10 (*b*) shows current waves of each section when the starting frame numbers $FS_{nm}$ are assigned as FIG. 9 (*b*) shows. In the above example, since the start timings to flow a pixel current at 3n+1st column, a pixel current at 3n+2nd column, and a pixel current at 3+3rd column, are dispersed to the fust frame, the third frame and the fifth frame respectively, the timings of flowing of the peak currents are further dispersed. Whereby, as FIG. 10 (*b*) shows, the peak value of the power source current of the common power source 13 can be suppressed.

FIG. 11 is an explanatory diagram to explain changes of the display density of respective pixels when the starting frame number $FS_{nm}$ is assigned for each column as 1, 2, 3, 1, 2, 3 . . . (in case of FIG. 8 (*a*)).

FIG. 11 shows pixels of 3×5 for comprehensiveness, where a horizontal axis represents the frame numbers from start of image writing. At the start of writing, all the pixels are erased and the display density is 0 (white), and writing is carry out so that all the pixels indicate the display density of 8 (black).

FIG. 11(*a*) shows that writing in the first frame has been completed, and the display density of the pixels in the fust column and the fourth column are 1. FIG. 11(*b*) shows that writing in the second frame has been completed and the display density of the pixels in the first column and the fourth column are 2 and that in the second column and the fifth column are 1.

FIG. 11(*c*) shows that writing in the third frame has been completed, and the display density of the pixels in the first column and the fourth column are 3, that in the second column and fifth column are 2, and that in the third column is 1.

FIG. 11(*d*) shows that writing in the seventh frame has been completed, and the display density of the pixels in the first column and the fourth column are 7, that in the second column and fifth column are 6, and that in the third column is 5.

FIG. 11(*e*) shows that writing in the eighth frame has been completed, and the display density of the pixels in the first column and the fourth column is 8, that in the second column and fifth column are 7, and that in the third column are 6. By writing in the eighth frame, the writing of fust column and the fourth column from the first frame is completed.

FIG. 11(*f*) shows that writing in the ninth frame has been completed, and the display density of the pixels in the second column and the fifth column are 8, that in the third column is 7. By writing in the ninth frame, the writing of the second column and the fifth column from the second frame is completed.

FIG. 11(*g*) shows that writing in the tenth frame has been completed, and the display density of the pixels in the third column is 8. By writing in the tenth frame, the writing of the third column from the third frame is completed, thus writing of all pixels has been completed. Namely, as the starting frame number $FS_{nm}$, values from one to three have been used, thus a period of ten times of the frame periods is used, wherein ten times of the frame period means a necessary number (eight times) to indicate the maximum display density plus a shifting amount (two times) of the starting frame.

On the other hand, as FIG. 9 (*b*) shows, in case the starting frame number $FS_{nm}$ is assigned as 1, 3, 5, 1, 3, 5 . . . for each column, the starting frame is shifted four times at maximum. Thus the display density of all the pixels becomes eight after writing in the 12th frame. Namely, if the shifting amount of the starting frame number $FS_{nm}$ is increased, the peak value of the power source current of the common power source 13 can be suppressed. Contrarily, the number of the frames by the time of completion of writing increase and there is a problem that image forming requires time. Also, if the starting frame number $FS_{nm}$ is shifted largely, there is a possibility that the difference of density with respect to an adjacent column which is in a middle way of writing is conspicuous. Thus the starting frame number $FS_{nm}$ is preferred to be at least less than the number of necessary frames to indicate the maximum density.

Next a method to make the difference of density between the columns inconspicuous will be described.

Figures 11A, 11B, 11C, 11D, 11E, 11F, 11G, 12:
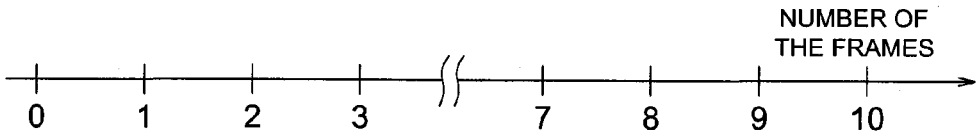
FIGS. 11*a*, 11*b*, 11*c*, 11*d*, 11*e*, 11*f*, and 11*g* are explanatory diagrams to explain an example of a change of display density of each pixel.
FIG. 12 is an explanatory diagram to explain an example wherein starting frame numbers $FS_{nm}$ are changed respectively for each of lines in addition to each of columns and assigned.

Next, FIG. 12 shows an example in which the starting frame number $FS_{nm}$ is changed and assigned to each line in addition to each column In the same manner as FIG. 9, the example is the display apparatus 100 having the display screen 50 with the pixel number (1024×768) of XGA where the dividing number Z is 3.

In the example in FIG. 12, the assigning section 82 determines the starting frame number $FS_{nm}$ using the formula (3) or formula (4) below.

In case n is an odd number $$FS_{nm}=\mathrm{mod}(((m+n)+2)/z)+1 \quad (3)$$

In case n is an even number $$FS_{nm}=\mathrm{mod}((1027-m-n)/z)+1 \quad (4)$$

Z denotes the dividing number, n denotes the line number, m denotes the column number and mod (A/B) is a function to obtain remainder of A/B. The numeral 1027 is a maximum pixel number in the line direction in FIG. 12 and Z is 3 in the present example.

In the above way, the difference of the density can be made inconspicuous compare to the case where starting frame number $FS_{nm}$ is shifted only for the columns Incidentally, the present invention is not limited to the example in FIG. 12. For example, the starting frame number $FS_{nm}$ can be determined by random numbers having a maximum value which is the dividing number Z.

Next, control to erase the image on the display apparatus 100 of the present embodiment will be described with reference to FIG. 13.

Figure 13:
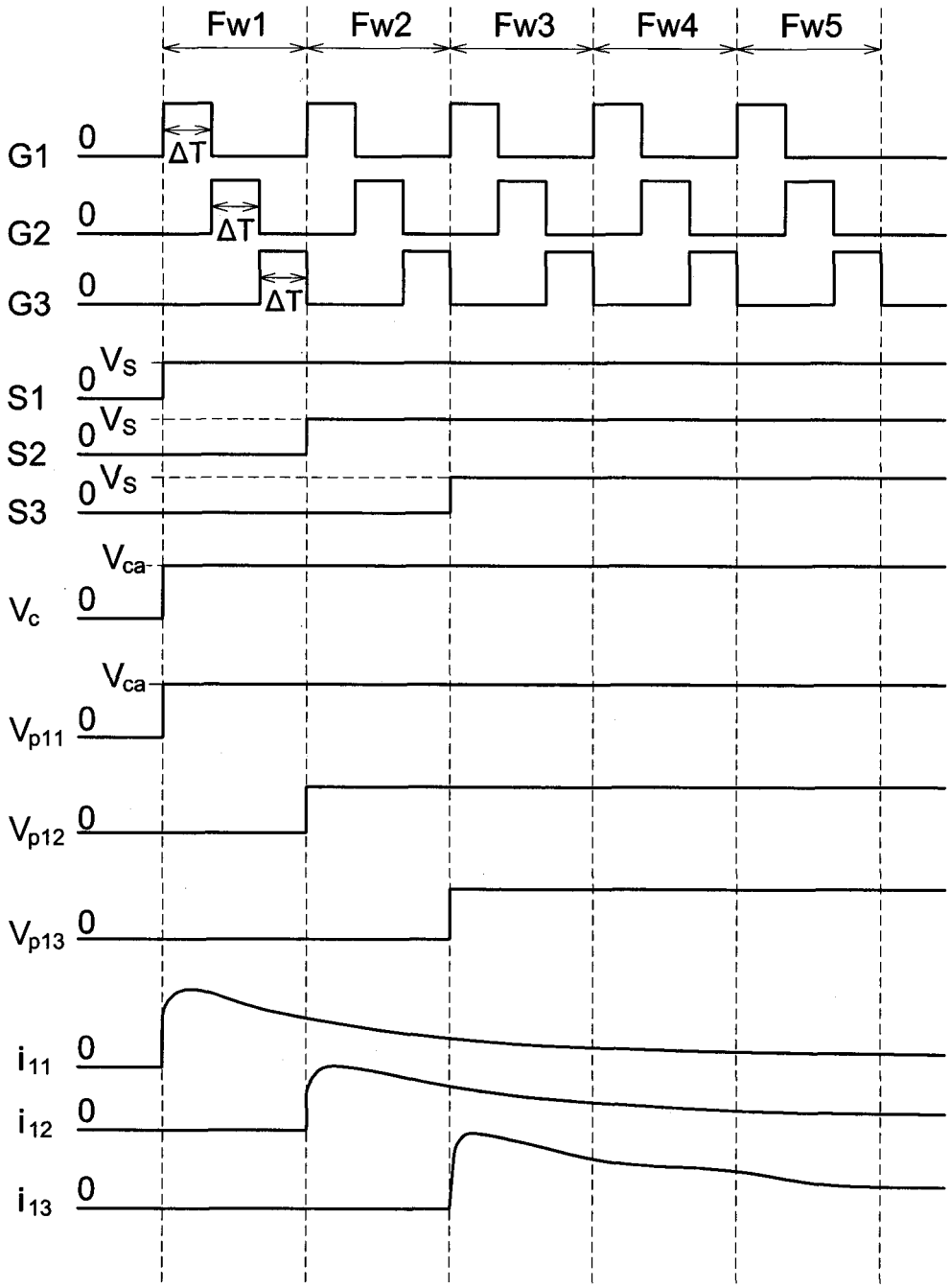
FIG. 13 is a time chart showing changes of voltages of each section when an image displayed by electrochemical display elements 1 is erased.

FIG. 13 is a time chart showing changes of the voltage of each section when the image of the electrochemical display elements 1 is erased. In the present example, when erasing of the image is started, display density of all the electrochemical display elements 1 is eight and by erasing the entire image the display density is made 0.

Using the time chart in FIG. 13, the voltages $V_{p11}$, $V_{p11}$ and $V_{p11}$ to be applied to P11, P12 and P13 in the fust line and the currents $i_{11}$, $i_{12}$ and $i_{13}$ flowing in P11, P12 and P13 will be described.

Incidentally, in the time chart in FIG. 13, the frames are indicated only up to Fw5 to simplify the drawing.

The procedure described with reference to the flow chart in FIG. 6 can be applied to erase the image. In the present example, the starting frame number $SF_{11}$ for P11 is 1, the starting frame number $SF_{12}$ for P12 is 2, the starting frame number $SF_{13}$ for P13 is 3. Thus the output S1 of the source driver 14 in the frame Fw1 is Vs and S2 and S3 are 0.

In the frame $F_{w1}$, $V_{ca}$ is applied to P11 and the current $i_{11}$ flows. As FIG. 13 shows, a peak current flows at an initial stage of application of the voltage onto P11 and gradually reduces afterwards.

In the frame $F_{w2}$, $V_{ca}$ is applied to P12 and the current $i_{12}$ flows. As FIG. 7 shows, a peak current flows at an initial stage of application of the voltage onto P12 and gradually reduces afterwards.

In the frame $F_{w3}$, $V_{ca}$ is applied to P13 and time the current $i_{13}$ flows in the same manner.

Thereafter, in the frame Fw4, and the frame Fw5 current flows in all the electrochemical display elements 1.

As above, also when the image is erased, by dispersing the timings of start to flow the current in the electrochemical display elements 1, the peak value of the current supplied from the power source can be suppressed. Therefore, the image can be unfailingly erased even by a power source circuit having a simple configuration with a small capacity, since fluctuations of the erasing voltage are suppressed.

As above, according to the present embodiments, a reflection type display apparatus capable of displaying the image having less unevenness can be provided using the power source circuit having the simple configuration with the small capacity.

DESCRIPTION OF THE SYMBOLS

1 Electrochemical display element
2 Driving transistor
4 Switching transistor
5*a*, 5*b*, 5*c* Scanning line
7*a*, 7*b*, 7*c* Bus line
8*a*, 8*b*, 8*c* Signal line
10 Memory
11 Control section
12 Gate driver
13 Common power source
14 Source driver
30 Silver electrode
31 Electrolyte
32 ITO electrode
34 Power source
80 ON pixel number calculation section
81 Diving number determination section
82 Assigning section
83 Voltage application control section
84 Frame control section

What is claimed is:

1. A display apparatus comprising: a plurality of electrochemical display elements arranged in a matrix comprising a plurality of rows and a plurality of columns; and a control section to apply voltage to each electrochemical display element to attain a desired display density so as to display a desired image by the plurality of display elements, the control section comprising:

an assigning section to divide the electrochemical display elements into at least two groups and to assign a starting frame number to each of the electrochemical display elements so that all electrochemical display elements in a same group have a same starting frame number, the display elements in each group being distributed among the rows and columns of the matrix;

a voltage application control section to start, during a first frame period, application of the voltage to each electrochemical display element to which a first starting frame number has been assigned and, thereafter, to start, during a second frame period, application of the voltage to each electrochemical display element to which a second starting frame number has been assigned; and a frame administration section to cause the voltage application control section to administer voltage to at least some of the electrochemical display elements in the at least two groups during a number of frame periods succeeding the first frame period until all electrochemical display elements in the at least two groups have attained the desired display density.

2. The display apparatus of claim 1, wherein the assigning section assigns a different starting frame number for each first display element in adjoining columns of the matrix.

3. The display apparatus of claim 2, wherein the assigning section assigns a different starting frame number for each first display element in adjoining rows of the matrix.

4. The display apparatus of claim 1, wherein the control section further comprises:

an ON pixel calculation section to calculate a number of the electrochemical display elements to which the voltage is to be applied based on image data of the desired image to be displayed; and a dividing number determination section to determine a dividing number to divide the plurality of the electrochemical display elements in accordance with the number calculated by the ON pixel calculation section, wherein the assigning section determines the number of groups based on the dividing number.

5. The display apparatus of claim 1, wherein a maximum value of the starting frame number is smaller than the number of frame periods succeeding the first frame period until all electrochemical display elements have attained the desired display density.

6. A method of driving a display apparatus comprising a plurality of electrochemical display elements arranged in a matrix comprising a plurality of rows and a plurality of columns, the method comprising:

dividing the electrochemical display elements into at least two groups, the display elements in each group being distributed among the rows and columns of the matrix; assigning a starting flame number to each of the electrochemical display elements so that all electrochemical display elements in a same group have a same starting frame number;

starting, during a first flame period, application of a voltage to each electrochemical display element to which a first starting frame number has been assigned and, thereafter, starting, during a second flame period, application of the voltage to each electrochemical display element to which a second starting frame number has been assigned; and continuing to apply the voltage to at least some of the electrochemical display elements in the at least two groups during a number of flame periods succeeding the first frame period until all electrochemical display elements in the at least two groups have attained a desired display density so as to display a desired image by the plurality of display elements.

7. The method of claim 6, further comprising starting, sequentially by group, application of the voltage to electrochemical display elements in groups assigned to a starting frame number other than the first and second starting frame numbers.

8. The method of claim 7, further comprising:

calculating a number of the electrochemical display elements to which the voltage is to be applied based on image data of the desired image to be displayed;

determining a dividing number to divide the plurality of the electrochemical display elements in accordance with the number calculated in the previous step; and determining the number of groups based on the dividing number.

* * * * *